US006148531A

United States Patent [19]

Economaki

[11] Patent Number: 6,148,531

[45] Date of Patent: Nov. 21, 2000

[54] TOOL FOR SETTING AND DETERMINING ANGLES

[75] Inventor: John J. Economaki, Portland, Oreg.

[73] Assignee: Bridge City Tool Works, Inc., Portland, Oreg.

[21] Appl. No.: 09/031,224

[22] Filed: Feb. 26, 1998

[51] Int. Cl.[7] ..... B43L 7/10

[52] U.S. Cl. ..... 33/465; 33/500

[58] Field of Search ..... 33/465, 418, 421, 33/424, 426, 452, 456, 458, 468–477, 495–500, 797–799, 801, 807, 808

[56] References Cited

U.S. PATENT DOCUMENTS

| | | | |
|---|---|---|---|
| 404,451 | 6/1889 | Waggoner | 33/500 |
| 655,005 | 7/1900 | Penfield | 33/471 |
| 732,827 | 7/1903 | Chambers | 33/497 |
| 883,908 | 4/1908 | Petterson | 33/473 |
| 1,006,948 | 10/1911 | Johnson | 33/424 |
| 1,534,865 | 4/1925 | Owens | 33/465 |
| 1,590,031 | 6/1926 | Imhof | 33/465 |
| 1,593,068 | 7/1926 | Gray | 33/456 |
| 3,635,942 | 1/1972 | Nicyper | 33/418 |
| 3,868,777 | 3/1975 | Bell | 33/433 |
| 4,394,801 | 7/1983 | Thibodeaux | 33/471 |

*Primary Examiner*—Andrew H. Hirshfeld
*Attorney, Agent, or Firm*—John S. Pratt; Kristin L. Johnson; Kilpatrick Stockton

[57] ABSTRACT

A tool for accurately determining and setting angles using an x beam and a y beam that pivot about a common axis and may be locked in position relative to each other with an axle lock and by locking one leg of each beam to a slotted stabilizer bar. Index holes on the x beam and the y beam receive movable index pins between which measurements are taken. Trigonometric calculation may be used, or a precalculated reference book or data table may be consulted, to determine or set the angle between the x and y beams for various index pins separations, when the pins are located in the various combinations of x and y beam holes. Relatively course linear measurements permit very fine angular measurements and settings.

2 Claims, 4 Drawing Sheets

TOOL FOR SETTING AND DETERMINING ANGLES

FIELD OF THE INVENTION

This invention relates to devices such as protractors and bevel gauges for setting and determining angles.

BACKGROUND OF THE INVENTION

The angles most frequently used in woodworking are 90° and 45°. Numerous accurate tools are available for setting, determining and creating those angles, and many tools like table saws and cut-off saws have built in stops to facilitate cutting at those angles. Determination of other angles, and setting tools such as table saw miter gauges is considerably more difficult. Protractors are typically used, but protractors are often difficult to read, and their size rarely permits fractional angle accuracy. Many machines have built-in protractor scales, but they are also difficult to read and typically inaccurate in use. Consequently, accurate machine set-up for operations requiring an uncommon angle is frequently a matter of laborious trial and error. This is most apparent when an effort is undertaken to produce a multi-side object with a number of sides other than four. Accordingly, there is a need, particularly in small woodworking shops, for a means for determining and marking angles accurately and for setting tools, such as saws, to make angled cuts with accuracy.

SUMMARY OF THE INVENTION

The present invention is a tool and method for accurately determining and setting angles. The angle gauge of the present invention utilizes two beams (an "x" beam and a "y" beam) that pivot about a common axis and may be locked in position relative to each other with an axle lock and by locking one leg of each beam to a slotted stabilizer bar. The longer arm of each beam is perforated with a series of spaced-apart holes labeled A–H on the x beam and 1–9 on the y beam. Movable index pins may be positioned in the holes. Trigonometric calculation may be used, or a precalculated reference book or data table may be consulted, to determine the angle between the x and y beams when index pins located in the various combinations of x and y beam holes are separated by specified distances. Conversely, the beams may be set at a desired angle with substantial accuracy by positioning the index pins in specified holes and then adjusting the beams to separate the index pins by a specified distance, which distance has been determined by trigonometric calculation or by reference to a precalculated reference book or data table. Because the index pins can be located in any of the holes 1–9 and A–H, it is possible (using beams less than two feet long) to identify a pin-to-pin distance in whole millimeter or 1/16 inch increments while achieving angle increments on the order of 0.05°. Thus, relatively course linear measurements permit very fine angular measurements and settings.

A data table may also correlate specified angles between the beams with distances between two fixed studs, one of which is fixed on each beam. Unknown angles may thus be determined by making linear measurements between the studs, particularly with dial or digital calipers. The availability of dial and digital caliper makes it practical to locate the studs on the shorter arms of the beams, relatively close to the axle on which the beam pivot.

A knob threaded onto the axle bolt about which the two beams pivot can lock the beams to each other in a desired location. Additional locking is achieved by tightening knobs against an arcuate, slotted stabilizer bar attached near the ends of the shorter legs of the tool. Substantial fractional angle accuracy is possible because relatively substantial changes (e.g., on the order of one millimeter or 1/16 inch) in distance between index holes in the two tool arms result in only small angular changes.

DETAILED DESCRIPTION OF THE DRAWINGS

Figure 1:
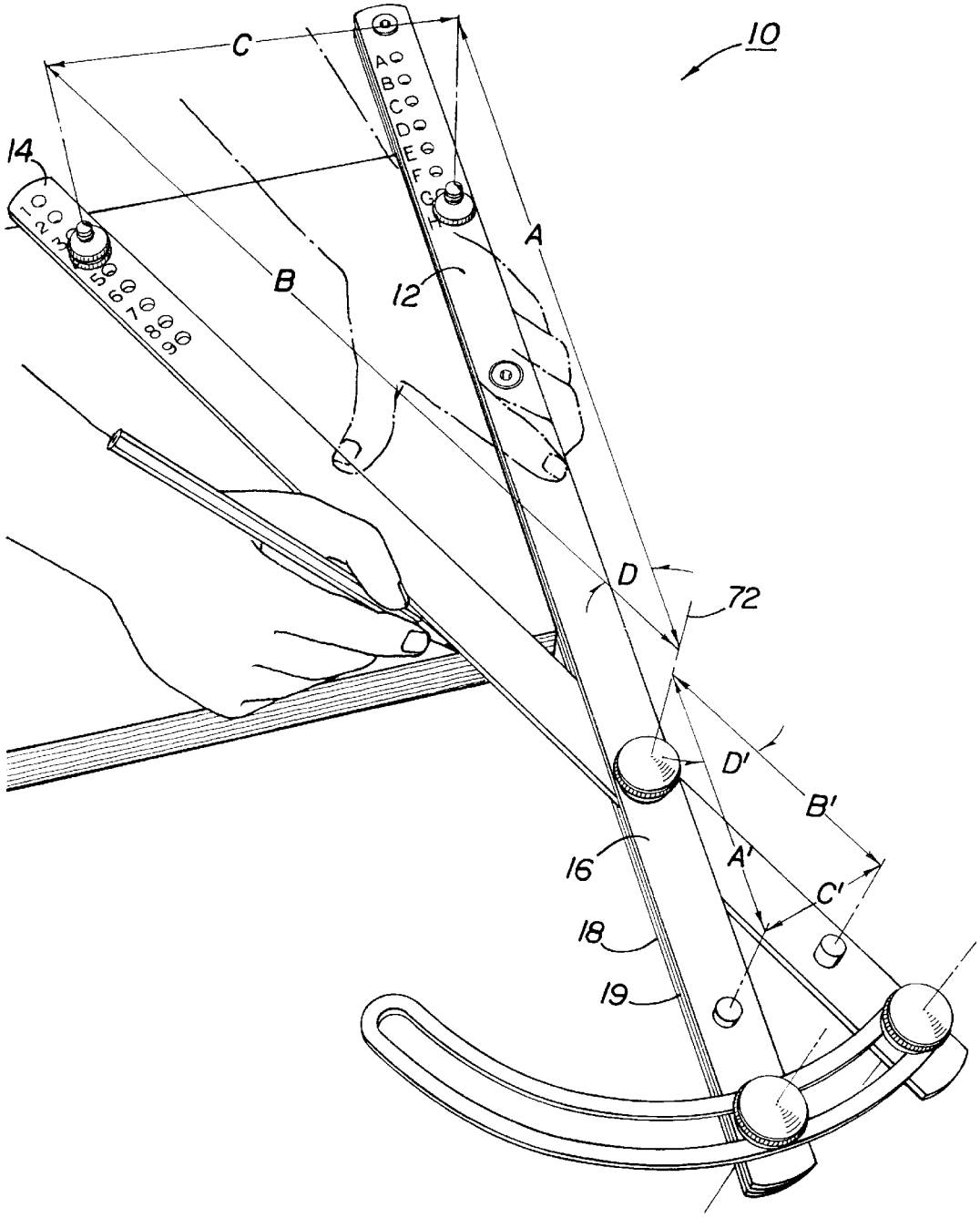
FIG. 1 is a perspective view of the angle measuring and setting tool of the present invention shown in position to mark a desired angle on a work piece.
Figure 2:
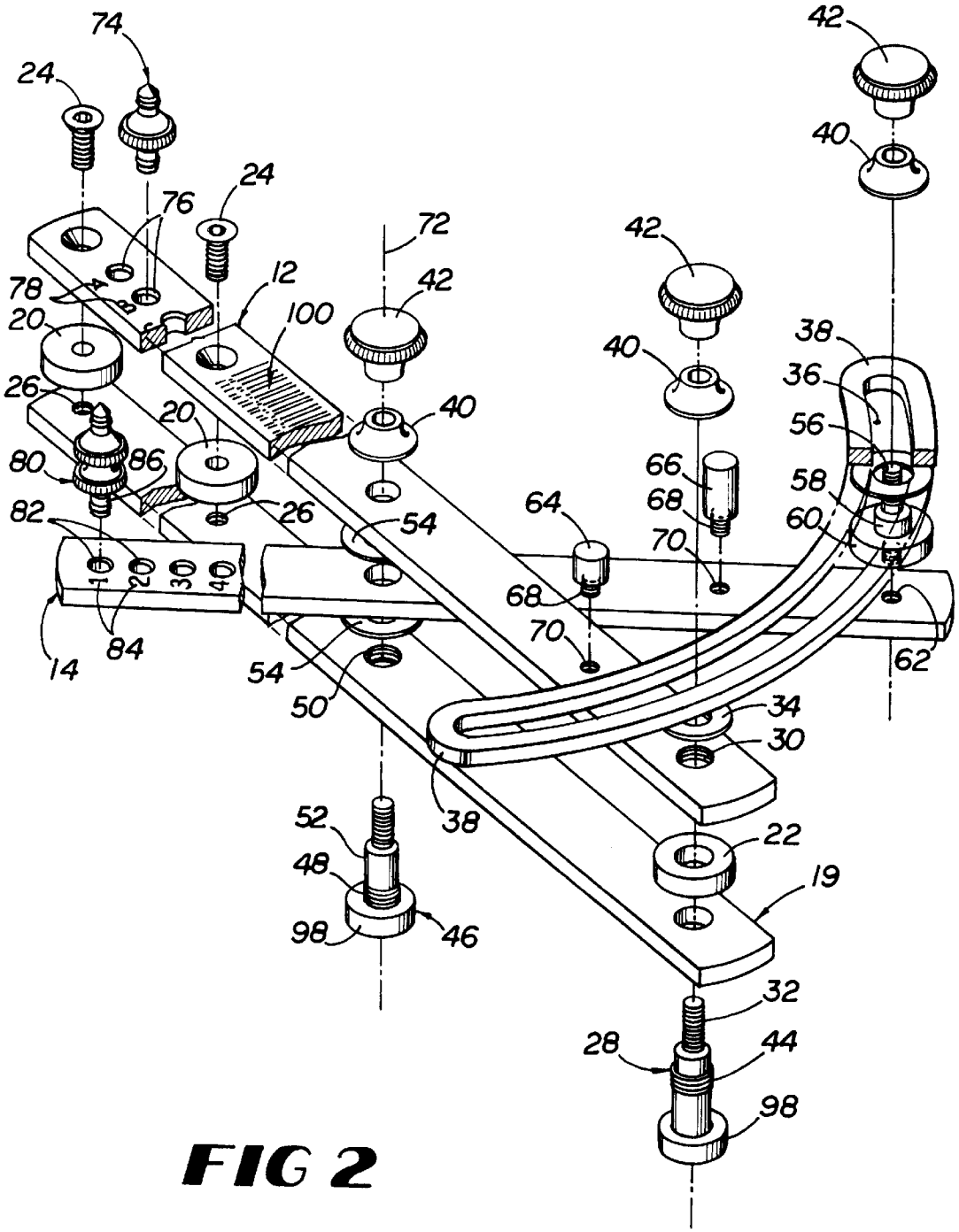
FIG. 2 is an exploded perspective view of the angle measuring and setting tool shown in FIG. 1.

As may be seen by reference to FIGS. 1 and 2, the angle measuring and setting the tool 10 of the present invention utilizes two "x" and "y" beams 12 and 14, respectively, that may conveniently be of equal length, but need not be. The y beam 14 may be fabricated from a bar of steel, aluminum, plastic or other suitable material and may be, for instance, 22 inches long, 1.25 inches wide and 2.25 inches thick. The x beam 12 may be fabricated of a top x bar 16 that lies above y beam 14 and a bottom x bar 18 that lies below y beam 14 and bars 16 and 18 may be the same dimension as y beam 14. The top 16 and bottom 18 of the x beam 12 are separated by spacers 20 and 22, essentially thick washers, that lie between the top 16 and bottom 18. Countersunk Allen head screws 24 pass through x beam top 16 and are received in threaded holes 26 in x beam bottom 18.

A stepped bolt 28 (also shown in FIG. 4B) is positioned near the end of the shorter arm 19 and of x beam 12 passes through x beam bottom bar 18, washer 22, and is threaded into a threaded hole 30 in x beam top bar 16. A smaller diameter threaded portion 32 of stepped bolt 28 passes through a thin washer 34, through the slot 36 in arcuate stabilizer bar 38, through a foot 40 and into a threaded knob 42. Foot 40 is essentially a thick, attractively shaped worker. By machining the threads on the larger portion 44 and in threaded hole 30 in one direction and the threaded end 32 of stepped bolt 28 and knob 42 in the other direction, tightening the knob 42 does not cause threaded stepped bolt 28 to back out of threaded hole 30 in x beam top 16. For instance, larger diameter portion 44 and threaded hole 30 might have left-hand threads while end 32 and knob 42 have right hand threads.

Numerous alternative structures for locking beams 12 and 14 in a desired position can be used. For instance, stabilizer bar 38 could be straight rather than arcerate or could be replaced by a threaded rod attached to or threaded through fittings attached to the beams 12 and 14, so that rotation of the rod in one direction causes beam arms to separate (forming a larger angle) and opposite rotation draws the arms together.

Similarly, there are alternative locking mechanisms usable rather than threaded knobs 42, such as spring loaded locks and cam-locking clamps.

An arrangement similar to bolt 28 is used to create the axle about which the beams pivot. That axle is provided by a stepped bolt 46 (well shown in FIG. 4B) that has a larger diameter threaded portion 48 immediately adjacent to the head 98 of bolt 46. Portion 48 threads into a threaded hole 50 in x beam bottom 18. This locks stepped bolt 46 to x beam bottom 18 and permits y beam 14 to pivot on a unthreaded portion 52 of stepped bolt 46. The y beam 14 is separated from the x beam top bar 16 and bottom bar 18 by thin washers 54. Stepped bolt 46 also passes through x beam top 16, a foot 40 and into a threaded knob 42, which can be tightened to lock the beams 12 and 14 in a selected angular relationship.

Figures 3, 4A:
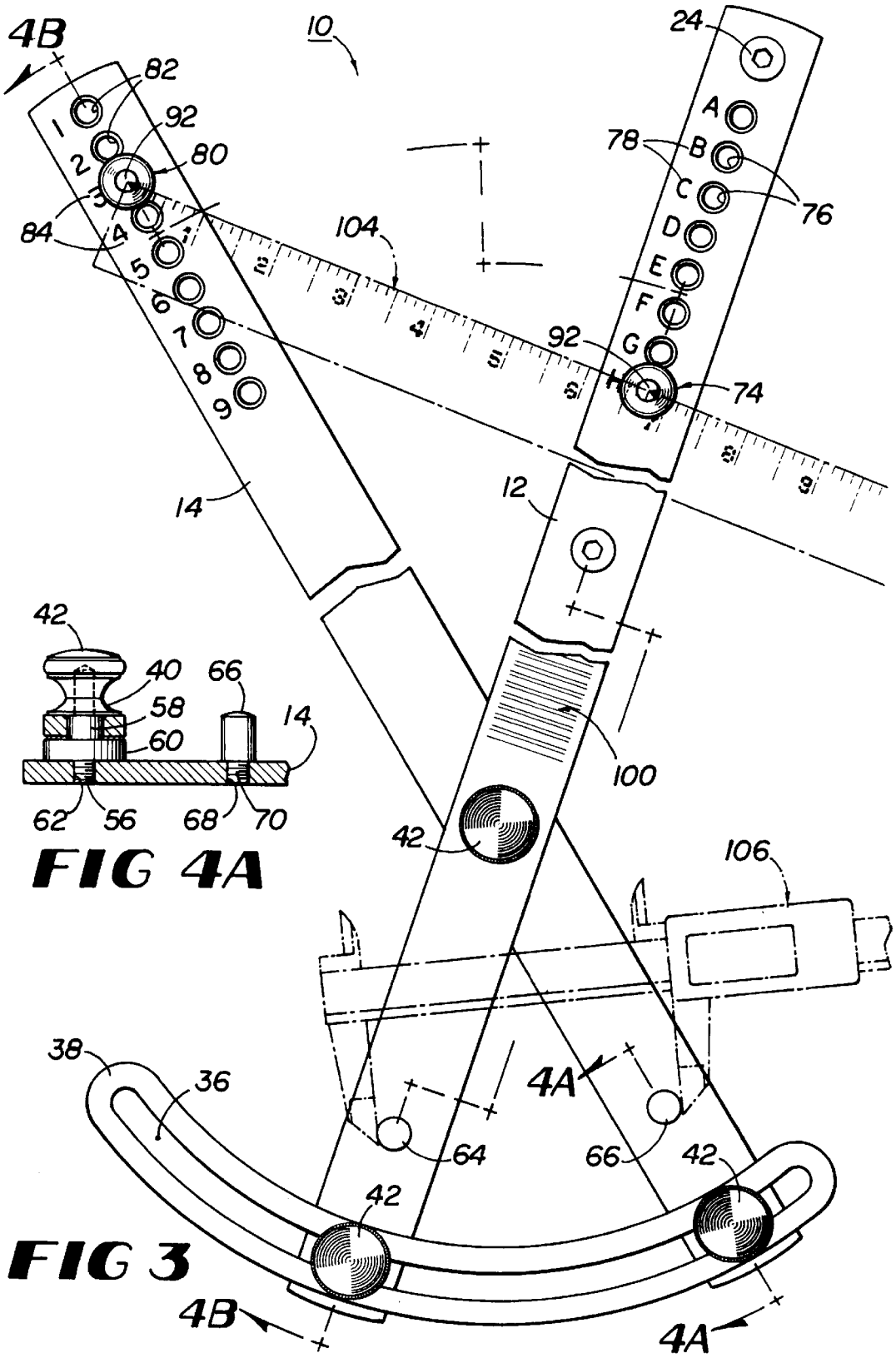
FIG. 3 is a top plan view of the tool shown in FIG. 1 with a rule and calipers indicated in proken lines.
FIG. 4A is a section view taken along 4A—4A in FIG. 3.

The y beam 14 may be locked to stabilizer bar 38 by tightening the threaded knob 42 on a threaded stud 56 (see also FIG. 4A). Stud 56 passes through a foot 40, the slot 36 in stabilizer bar 38, a small diameter washer 58 that is positioned within slot 36, a thick washer 60 that lies between stabilizer bar 38 and y beam 14, and into a threaded hole 62 in y beam 14.

Micrometer studs 64 and 66 have a smaller diameter threaded end 68 and are threaded into threaded openings 70, located in a convenient location on y beam 14 and x beam top bar 16, preferably but not necessarily equal distances from the pivot axis 72. As may be seen by reference to the figures, micrometer stud 66 is taller than micrometer stud 64 so that their tops lie in the same plane, facilitating avoidance of parallax error when measuring the distance between studs 64 and 66. Referring to FIG. 1, measurements of stud 64 and 66 separation C' can be used to trigonmetrically calculate the angle D' between beams 12 and 14 using known distances A' and B' between the studs 64 and 66 and axis 72. Indeed, a digital micrometer positioned to measure the distance (e.g., C') between predetermined points on the two beams 12 and 14 could be programmed to calculate and directly display the angle D' between beams 12 and 14 as they pivot (distances A' and B' would remain constant).

A shorter index pin 74 is received in any of a series of spaced-apart holes 76 in x beam top 16, which space bar holes 76 are marked with indicia 78 that may, for instance, be the letters A through H. A taller index pin 80 is received in a similar series of holes 82 in y beam 14. The holes 82 are also marked with indicia 84 that may, for instances, be the numerals 1 through 9.

Figures 4B, 5, 6, 7:
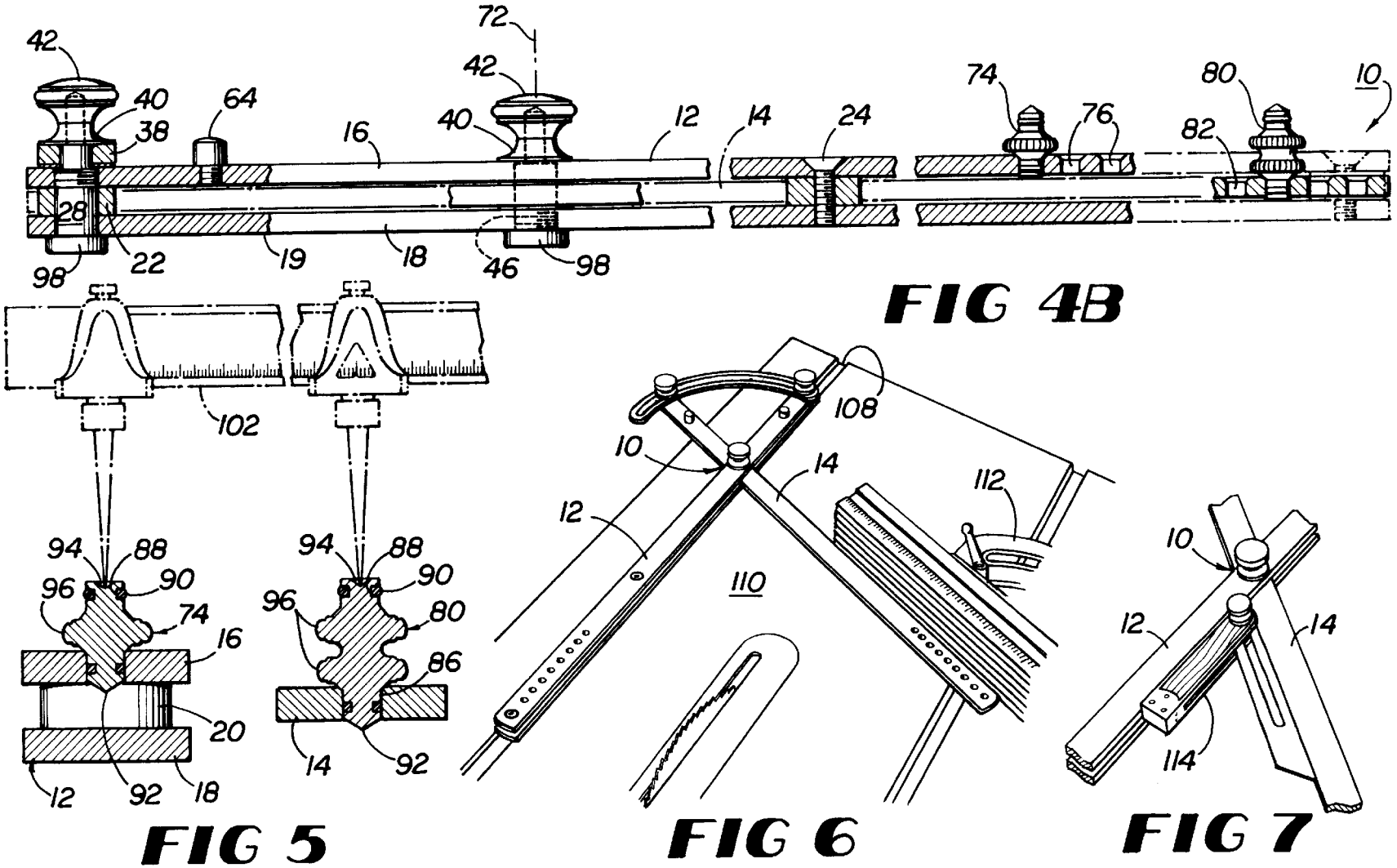
FIG. 4B is a section view taken along 4B—4B in FIG. 3.
FIG. 5 is a side elevational view, in section, taken through the index pins, with a beam compus shown in broken lines.
FIG. 6 is a perspective view of the tool shown in FIG. 1 positioned on a miter slot on a table saw being used to set a miter gauge.
FIG. 7 is a perspective view of the tool shown in FIG. 1 being used to set a bevel gauge.

Each index pin 74 and 80 has a shaft 86 substantially equal in diameter to the holes 76 and 82. As shown in FIG. 5, an annular depression 88 near each end of shaft 86 receives a neoprene or rubber O-ring 90 that is compressed when the index pin 74 or 80 is inserted in one of the holes 76 or 82, thereby preventing the pin 74 or 80 from falling out. One end 92 of each index pin 74 and 80 is conical and the other end 94 has a conical depression so that the distance c (FIG. 1) between pins 74 and 80 can be measured using trammel compass 102 points seated in the conical depressions 94 (e.g., FIG. 5) or using, for instance, a ruler 104 by reference to conical points 92 as is illustrated in FIG. 3. Larger diameter knurled portions 96 on the index pins makes it easy to grasp them to insert and remove the pins 74 and 80.

Numerous alternatives to the holes 76 and 82 and index pins 74 and 80 could be utilized on beams 12 and 14 as reference points for measurement. For instance, reference cross hairs or dots could be engraved, machined, screened or otherwise affixed on beams 12 and 14, and measurements could be made by reference to such markings.

A table of angles D can be calculated for various positions of the index pins 74 and 80 using the lengths of triangle sides A, B, and C, using appropriate trigonometric formulas to solve for angles when lengths A, B and C are known, or to determine length C when lengths A and B and angle D are known.

Such a table (or portions of it) can be placed on one or both of the beams 12 and 14 as data 100 shown in FIG. 2. A table can also be printed in booklet form or can be maintained in a computer data base. A computer can also be programmed to calculate desired lengths and angles as needed in the course of use of tool 10.

The following examples illustrates the versatility of tool 10.

EXAMPLE 1

Setting a Predetermined Angle

There are two ways to adjust tool 10 to a desired angle from a table of angles corresponding to index pin locations and distances separating the index pins. For this example, assume the desired angle is 53.55 degrees.

Method 1.

1. Locate 53.55 degrees in the table.
2. (Reading from a table that specifies "B," "2" and "$12\frac{15}{16}$ inches" opposite 53.55°) place the short index pin 74 in the hole marked "B" in x beam 12. If the angle setting is to be made using a rule 104 as illustrated in FIG. 3, insert the index pins 74 and 80 with their conical ends 92 up. If a beam compass or trammel 102 is to be used as illustrated in FIG. 5, the other ends 94 with conical depressions should be up.
3. Place the long index pin 80 in the hole marked "2" in y beam 14.
4. With the knobs 42 unlocked, adjust the center distances of the index pins 74 and 80 to $12\frac{15}{16}$ inches by pivoting y beam 14 relative to x beam 12. Then, lock all three knobs 42. The tool 10 is now set to 53.55 degrees.

Method 2.

1. (Reading from a table that specifies micrometer stud separation of 3.9516" or 100.37 mm opposite 53.55°) set a dial or digital caliper 106 to 3.9516" or 100.37 mm. Adjust the tool 10 by pivoting y beam 14 relative to x beam 12 until the caliper 106 traps the outside diameters of the two studs 64 and 66 as illustrated in FIG. 3.
2. Lock the tool 10 by tightening the knobs 42. The tool 10 is now set to 53.55 degrees.

EXAMPLE 2

Transferring An Unknown Angle Directly To The Tool 10 For Identification Tool 10 can be used to determine an unknown angle either on a piece of stock or T-bevel setting. Here are the two methods.

Method 1.

1. Set the tool 10 so the sample nests within the beams 12 and 14 long arms and lock the knobs 42.
2. Place the short index pin 74 in the hole marked "A" in x beam 12.
3. Place the long index pin 80 in the hole marked "1" in y beam 14.
4. Measure the center distance of the index pins (as is illustrated using a rule 104 in FIG. 3) and locate the closest setting from a reference table of angles corresponding to distances between holes "A" and "1". Due to rounding, there may be two or three angles for the same setting. This method is accurate to within ¼ of a degree for beams 12 and 14 approximately 22 inches long.

Method 2

1. Set the tool 10 so the sample nests within the beams 12 and 14 and lock the knobs 42.
2. Adjust a pair of dial or digital calipers 106 to measure the distances between studs 64 and 66 (by "capturing" the studs 64 and 66 between the caliper arms as shown in FIG. 3).
3. Locate in a reference table the angle in the table that corresponds to the stud 64 to stud 66 distance closest to the measured distance.

(Alternatively, the angle between beams 12 and 14 can be calculated using the measured distance the studs 64 and 66 are separated and the distances of the studs 64 and 66 from axis 72).

EXAMPLE 3

Transferring An Angle Directly To A Table Saw Miter Gauge

The heads 98 of stepped bolts 28 and 46 can be a diameter that fits snugly in typical machinery miter gauge slots such as slot 108 in table saw 110 in FIG. 6, which slots 108 are usually ¾ inch wide. These heads 98 "freeze" the tool 10 in the miter gauge slot 108 for the purpose of setting the miter gauge 112. Once the tool 10 is set using one of the methods described above, the bolt heads 98 are positioned in one of the miter gauge slots 108 on the table saw 110. The y beam 14 will extend in such a manner that a table saw 110 miter gauge 112 can be positioned directly from the tool 10.

EXAMPLE 4

Transferring An Angle From the Tool 10

Once the tool 10 is set, the angle can be transferred to a T-bevel 114 or adjustable square by nesting the T-bevel 114 or adjustable square between beams 12 and 14 of the tool 10 as is shown in FIG. 7. The T-bevel 114 can then be used to tilt saw blades, set machinery fences or in numerous other applications.

As will be appreciated by those skilled in the art, numerous modifications can be made in tool 10 without depositing from the spirit and scope of the invention as described in the following claims. For instance, the beams could pivot on an axle located near the beam ends so that each beam has a single arm, and all of micrometer studs 64 and 66, stabilizing bar 38 and index holes 76 and 82 (or other reference devices) could be located on those arms.

I claim:

1. A tool for setting and measuring angles, comprising:

first, second and third metal bars of substantially the same length, each of the bars having two ends and an axle hole centered substantially the same distance from one of the bar ends, spacers and fasteners locking the first and third metal bars one above the other and spaced apart a distance sufficient to permit the second bar to be positioned between the first and third bars with an axle positioned in the three axle holes so that the second bar can pivot relative to the joined first and third bars, a plurality of index holes in adjacent portions of each of the first and second bars, two index pins for positioning in the index holes in each of the first and second bars, means for locking the annular position of the second bar relative to the first bar, and a stabilizing bar for attachment between the first and second bars to fix the angle between those bar, wherein the stabilizing bar comprises a metal plate penetrated by a slot, threaded studs protrude from the first and second bars and through the slot, and threaded knobs received on the threaded studs releasably lock the stabilizing bar in position on the first and second bars.

2. A tool for setting and measuring angles, comprising:

first, second and third aluminum bars of equal length and width, each of the bars having two ends and an axle hole centered substantially the same distance from one of the bar ends, and the first and second bars having a plurality of index holes, spacers positioning the first and third metal bars one above the other and spaced apart a distance sufficient to permit the second bar to be positioned between the first and third bars, at least two screws passing through one of the first and third bars and into threaded holes in the other of the first and third bars to lock them together, an axle bolt passing through the axle holes in the first, second and third bars and into a threaded knob so that the second bar can pivot relative to the joined first and third bars with the axle knob loose and the second bar is locked in position relative to the first and third bars with the axle knob tightened, an arcuate stabilizing bar penetrated by a slot, a threaded member protruding from each of the first and second bars, to pass through the slot and to receive a threaded knob so that the stabilizing bar can be removably fixed to the first and second bars to lock their positions relative to each other, a first stud attached to the first bar and, attached to the second bar, a second stud that is longer than the first stud by approximately the thickness of the first bar, for positioning in any of the plurality of index holes in the first bar, a first reversible index pin having a conical tip on one end and a depression in the other end, and for positioning in any of the plurality of index holes in the second bar, a second index pin which is longer than the first pin by approximately the thickness of the first bar and which has a conical tip on one end and a depression in the other end.

* * * * *